US006676433B1

(12) United States Patent
Ozaki

(10) Patent No.: US 6,676,433 B1
(45) Date of Patent: Jan. 13, 2004

(54) CONNECTOR

(75) Inventor: Masahito Ozaki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 222 days.

(21) Appl. No.: 09/609,548

(22) Filed: Jul. 3, 2000

(30) Foreign Application Priority Data

Jul. 2, 1999 (JP) ..... P 11-189259

(51) Int. Cl.[7] ..... H01R 13/648

(52) U.S. Cl. ..... 439/353; 439/350; 439/352; 439/370; 439/595; 439/752

(58) Field of Search ..... 439/350, 351, 439/352, 353, 354, 355, 356, 357, 358, 370, 594, 595, 599, 752

(56) References Cited

U.S. PATENT DOCUMENTS 5,190,467 A * 3/1993 Ohta ..... 439/350
5,203,719 A * 4/1993 Kozono ..... 439/357
5,234,356 A * 8/1993 Maejima et al. ..... 439/352
5,338,219 A * 8/1994 Hiramoto et al. ..... 439/350
5,391,090 A * 2/1995 Power ..... 439/354
6,171,130 B1 * 1/2001 Yoshida et al. ..... 439/352

FOREIGN PATENT DOCUMENTS

| | | | |
|---|---|---|---|
| EP | 0 698 946 A1 | 2/1996 | |
| EP | 0 729 202 A2 | 8/1996 | |
| JP | 52-26980 | 2/1977 | ..... H01R/13/02 |
| JP | 55-64277 | 5/1980 | ..... H01R/13/432 |
| JP | 2000-58204 | 2/2000 | ..... H01R/13/648 |

* cited by examiner

*Primary Examiner*—Truc Nguyen
(74) *Attorney, Agent, or Firm*—Sughrue Mion, PLLC

(57) ABSTRACT

An elastic portion (24) is provided at a bottom surface of a fitting hole (22) formed in a housing (21) of a female connector (20). When a housing (31) of a male connector (30) reaches a reference position (B) during a connector-fitting operation, a bottom surface of the housing (31) contacts a distal end portion **(24*b*) of the elastic portion (24), and presses and displaces this distal end portion (24*b*) downward. Because of a reaction force produced as a result of this displacement, the elastic portion (24) keeps on urging the housing (31) of the male connector (30) in a direction (upward) of fitting of a lock portion (33) into a lock portion-retaining portion (33)**.

23 Claims, 3 Drawing Sheets

CONNECTOR

BACKGROUND OF THE INVENTION

1. Field of the Invention

The present invention relates to a connector used for connecting wire harnesses to each other. Particularly, the present invention relates to a structure in which the shaking and vibration of housings of connectors relative to each other are absorbed when the housings has been fitted to each other, thereby positively preventing the incomplete contact, uneven wear and so on of terminals received in the housings.

The present application is based on Japanese Patent Application No. Hei. 11-189259, which is incorporated herein by reference.

2. Description of the Related Art

Referring to FIGS. 5 to 7, a related connector 40 comprises a female connector 50, including a housing 51 having male terminals (not shown) mounted therein, and a male connector 60 including a housing 61 having female terminals (not shown) mounted therein. When the male connector 60 is fitted into the female connector 50, the male terminals are contacted with the female terminals, respectively, and therefore are electrically connected thereto, respectively.

In this connector 40, the male connector 60 is fitted into a fitting hole 52 in the female connector 50 while a pair of ribs 62, formed on an upper surface (FIG. 5) of the housing 61 of the male connector 60, are guided respectively by a pair of ribs 53 formed on an inner surface of the fitting hole 52 in the housing 51 of the female connector 50.

When the male connector 60 is fitted into the female connector 50, a lock portion 63, formed on the upper surface (FIG. 5) of the housing 61 of the male connector 60, is fitted into and retained by a lock portion-retaining portion 54 formed in an upper surface of the housing 51 of the female connector 50. Therefore, the two connectors 50 and 60 are prevented from disengagement from each other.

In the above connector 40, there is a possibility that a relative movement (shaking movement) occurs between the housings 51 and 61 when the male connector 60 is kept fitted in the female connector 50. When a relative movement develops between the housings 51 and 61, there has been encountered a problem that the incomplete contact, uneven wear and so on of the connector terminals occur, thus lowering the performance and durability of the connector 40.

A relative movement between the housings 51 and 61 can be reduced by increasing the dimensional accuracy of the various portions of the connector 40. However, from the viewpoint of the cost and others, it has been difficult to increase the dimensional accuracy.

Also, a relative movement between the housings 51 and 61 can be reduced, for example, by so adjusting the dimensions of the housings 51 and 61 that the male connector 60 can be inserted into the female connector 50 in a somewhat press-fitted manner. However, this invites a problem that the insertion force, required for the connector 40, increases.

SUMMARY OF THE INVENTION

It is an object of the present invention to provide a connector in which a relative movement (shaking movement) between housings of connectors, connected together, can be suppressed as much as possible while keeping the required insertion force of the connector to a low level, thereby positively preventing the incomplete contact, uneven wear and so on of connector terminals.

To achieve the above object, according to the first aspect of the present invention, there is provided a connector which comprises a female connector housing into which a male terminal is insertable, a male connector housing, into which a female terminal is insertable, and which is fittable in the female connector housing so that the female terminal of the male connector housing is electrically connected to the male terminal of the female connector housing, and an urging mechanism disposed on at least one of the female and male connector housings, the urging mechanism keeping on urging at least another of the female and male connector housings when the male connector housing is fitted in the female connector housing. Accordingly, a relative movement between the female and male connector housings which have been fitted to each other, is sufficiently suppressed by an urging force applied from the urging mechanism.

According to the second aspect of the present invention, the connector may further comprises a lock portion provided at one of the female and male connector housings, and a lock portion-retaining portion provided at the other one of the female and male connector housings, wherein when the male connector is fitted in the female connector, the lock portion-retaining portion retains the lock portion so as to hold the female and male connector housings in a mutually-fitted condition. In such the connector, when the male connector housing is fitted in the female connector housing, the urging mechanism keeps on urging at least one of the female and male connector housings in a direction in which retainment of the lock portion by the lock portion-retaining portion is reinforced. Accordingly, a relative movement between the female and male connector housings which has been fitted to each other, is sufficiently suppressed by the urging force applied from the urging mechanism, and besides the cancellation of the retainment of the lock portion by the lock portion-retaining portion is prevented by this urging force.

According to the third aspect of the present invention, it is preferable that the urging force, applied from the urging mechanism, begins to act on at least one of the female and male connector housings when the male connector is located into a predetermined position in the female connector. In such the connector, the urging force, applied from the urging mechanism, does not act before the male connector housing is fitted into the predetermined position in the female connector housing. Therefore, before the male connector housing is fitted into the predetermined position in the female connector housing, the insertion force, required for fitting the female and male connector housings, is kept to a low level, and in the connector-fitted condition, a relative movement between the two housings is sufficiently suppressed.

Further, according to the fourth aspect of the present invention, it is preferable that the urging mechanism comprises an elastic portion formed integrally on the at least one of the female and male connector housings, wherein the connector further comprises a guide portion having a recessed portion, the guide portion being formed on the at least one of the female and male connector housings, and wherein the elastic portion is located in the recessed portion of the guide portion.

Furthermore, according to the fifth aspect of the present invention, it is preferable that the elastic portion is formed in a cantilever-like manner, and a distal end portion of the elastic portion is slightly projected from an upper surface of the guide portion.

DETAILED DESCRIPTION OF THE PREFERRED EMBODIMENT

A preferred embodiment of the present invention will now be described with reference to FIGS. 1 to 4.

Figure 1:
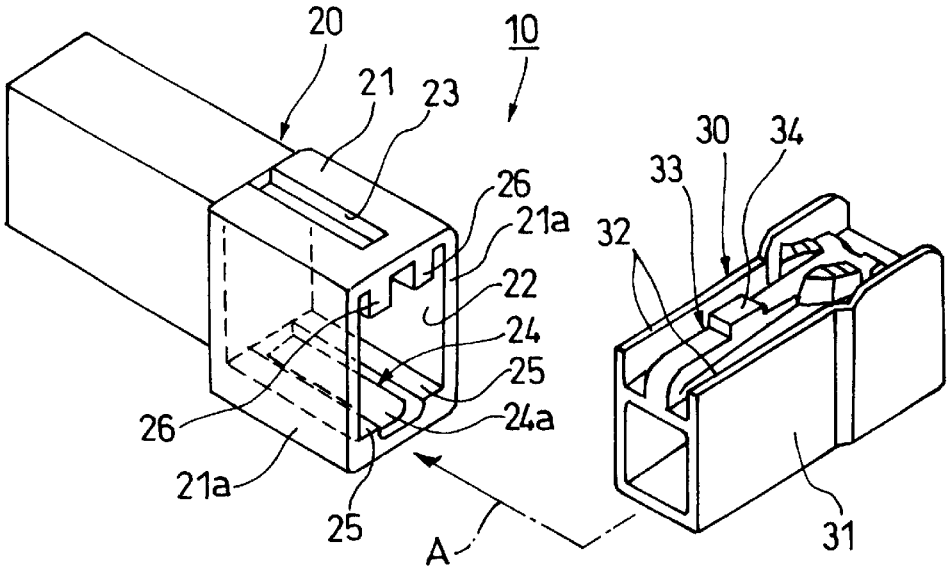
FIG. 1 is a perspective view of one preferred embodiment of a connector of the present invention, showing a condition before female and male connectors are brought into a fitted condition.
Figure 2:
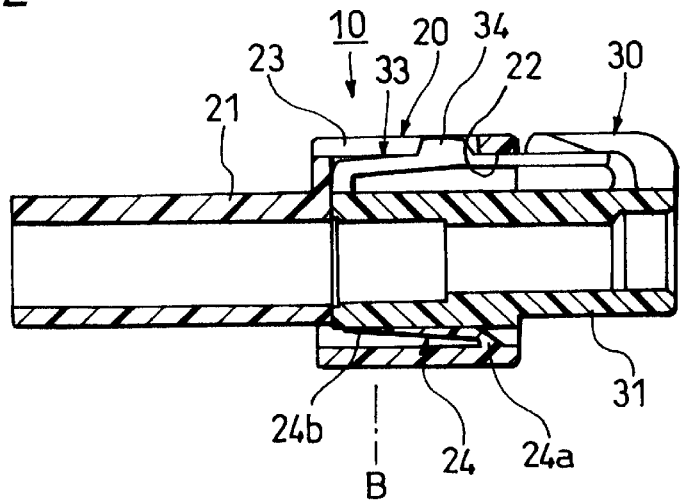
FIG. 2 is a cross-sectional view showing the fitted condition of the female and male connectors of FIG. 1.

In FIGS. 1 and 2, the connector 10 comprises the female connector 20, including a housing 21 having male terminals (not shown) mounted therein, and a male connector 30 including a housing 31 having female terminals (not shown) mounted therein. The male connector 30 is fitted into the female connector 20 along a predetermined direction (hereinafter referred to as "connector fitting direction A"). As a result, in the connector 10, an insertion tab (not shown) of each male terminal is inserted between a pair of contact pieces (not shown) of the associated female terminal, and is contacted therewith under a predetermined contact load, thereby achieving an electrical connection between the male and female terminals.

The housing 21 of the female connector 20 has a fitting hole 22 for fitting on the housing 31 of the male connector 30. The male terminals are provided at a left side portion (FIG. 2) of the fitting hole 22 in the housing 21 of the female connector 20.

A lock portion-retaining portion 23 is formed in an upper surface (FIG. 1) of the fitting hole 22 in the housing 21 of the female connector 20. When the housing 31 of the male connector 30 is fitted into the fitting hole 22 in the housing 21 of the female connector 20 at the time of connecting the connector 10 (hereinafter referred to as "at the time of connection of the connector"), a lock portion 33 of the male connector 30 (described later) is fitted into the lock portion-retaining portion 23.

An elastic portion (elastic member) 24 is formed on a lower or bottom surface (FIG. 1) of the fitting hole 22 in the housing 21 of the female connector 20, and a pair of guide portions 25 are also formed on the bottom surface of the fitting hole 22, and are disposed on opposite sides of the elastic portion 24, respectively. In this embodiment, the elastic portion 24 is formed in a cantilever-like manner, and is located in a recessed portion formed between the guide portions 25. The pair of guide portions 25 may be formed integrally with each other as one guide portion that has the recessed portion formed therein.

The elastic portion 24 is formed integrally at its proximal end (front side portion in FIG. 1) 24*a* with the housing 21, and extends toward an inner end (FIG. 1) of the fitting hole 22 along the connector fitting direction A, the elastic portion 24 having a predetermined length L in the connector fitting direction A. The elastic portion 24 can be easily molded by using an existing molding technique in which a slide metal core is moved from a fixed metal mold during the molding of the housing 21 of the female connector 20, and therefore the manufacturing cost is not increased.

A distal end portion 24*b* of the elastic portion 24 can be turned or displaced downward (FIG. 2) in a predetermined amount about the proximal end 24*a*. At the time of connection of the connector, a bottom surface of the housing 31 of the male connector 30 is brought into contact with the elastic portion 24, and presses and displaces this elastic portion 24 downward (FIG. 2), so that the distal end portion 24*b* of the elastic portion 24 is displaced downward (FIG. 2) in the predetermined amount. Therefore, because of a reaction force produced as a result of this displacement, the elastic portion 24 keeps on urging the housing 31 of the male connector 30 in a direction (upward in FIG. 2) of fitting of the lock portion 33 into the lock portion-retaining portion 23.

Figure 3:
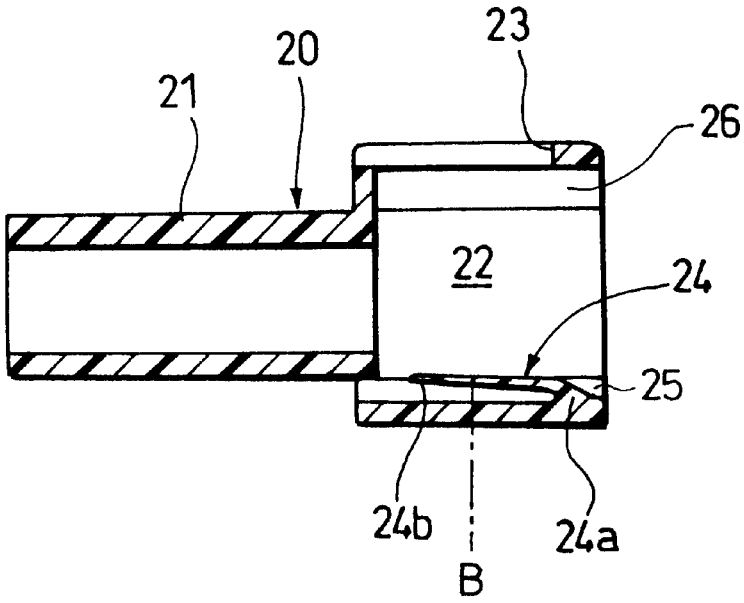
FIG. 3 is a cross-sectional view of the female connector of FIG. 1.
Figure 4:
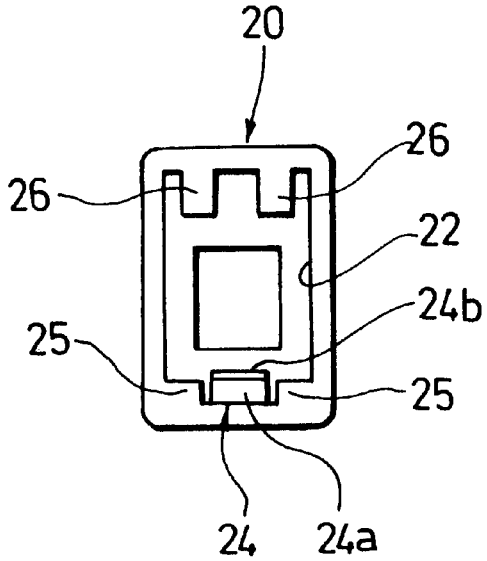
FIG. 4 is a right end view of the female connector of FIG. 3.
Figure 5:
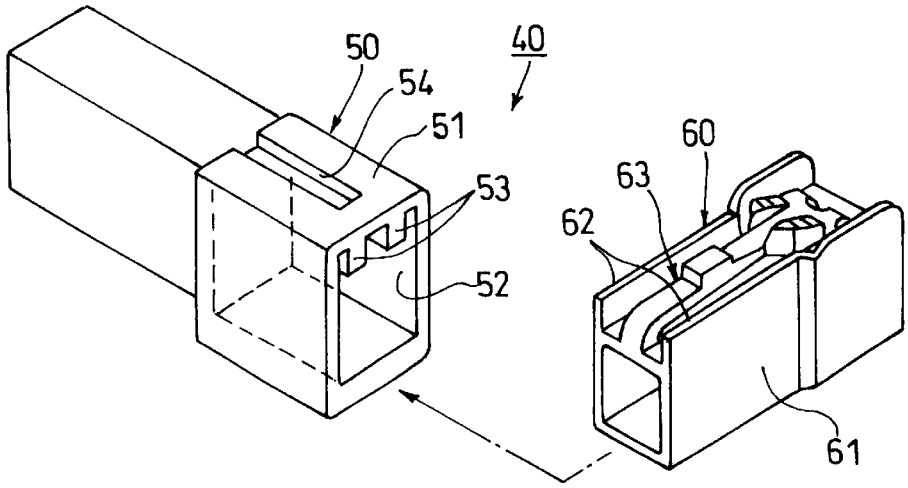
FIG. 5 PRIOR ART
FIG. 5 is a perspective view of a related connector, showing a condition before female and male connectors are brought into a fitted condition.
Figure 6:
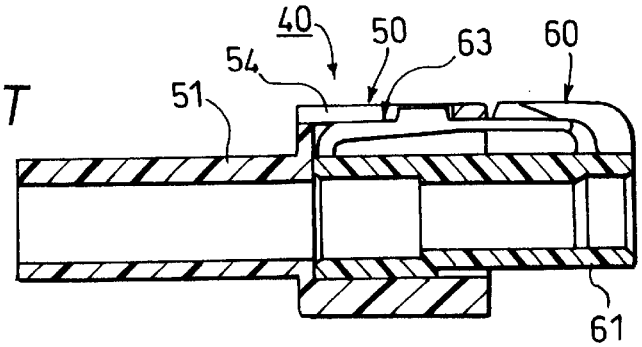
FIG. 6 PRIOR ART
FIG. 6 is a cross-sectional view showing the fitted condition of the female and male connectors of FIG. 5.
Figure 7:
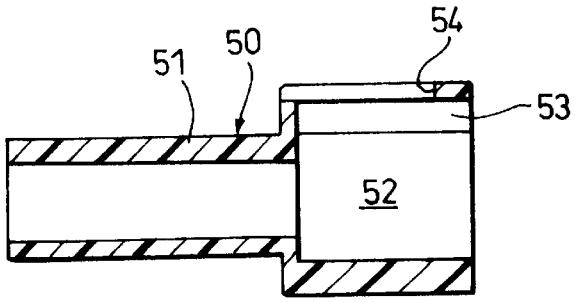
FIG. 7 PRIOR ART
FIG. 7 is a cross-sectional view of the female connector of FIG. 5.

The two guide portions 25 extend toward the inner end (FIG. 1) of the fitting hole 22 along the connector fitting direction A in generally parallel relation to the elastic portion 24. As shown in FIG. 3, an upper surface of that portion of the elastic portion 24 having a predetermined distance defined between the distal end (tip) of the elastic portion 24 and a reference position B is slightly higher than the respective upper surfaces of the guide portions 25. In other words, that portion of the elastic portion 24 extending from the distal end of the elastic portion 24 toward the proximal end 24*a* until the reference position B is slightly projected from the respective upper surfaces of the guide portions 25 as viewed in the cross section of FIG. 3. At the time of connection of the connector, the bottom surface (FIG. 2) of the housing 31 of the male connector 30 is abutted against the guide portions 25, and slides thereon, and thus the guide portions 25 guide the housing 31 toward the inner end (FIG. 1) of the fitting hole 22 while holding the housing 31 in a predetermined posture.

Namely, until the front end of the housing 31 of the male connector 30 in the connector fitting direction A reaches the vicinity of the reference position B of the elastic portion 24, the two guide portions 25 are held in sliding contact with the housing 31 of the male connector 30 within the fitting hole 22 in the housing 21 of the female connector 20, thereby preventing the housing 31 of the male connector 30 from coming into contact with the elastic portion 24. Therefore, the guide portions 25 prevent damage to the elastic portion 24 caused, for example, upon impingement of the housing 31 of the male connector 30 thereon.

A pair of ribs 26 are formed on and project downwardly (FIG. 1) from the inner surface (upper surface in FIG. 1) of the fitting hole 22 in the housing 21 of the female connector 20. More specifically, the ribs 26 are spaced from each other in a direction perpendicular to the connector fitting direction A, and extend along the connector fitting direction A in generally parallel relation to each other. The lock portion 33 of the male connector 30 (described later) can be inserted between the ribs 26. A space is formed between each of the ribs 26 and a corresponding side wall 21*a* of the housing 21, and each of ribs 32 of the male connector 30 (described later) can be inserted into this space.

At the time of connection of the connector, the male connector 30 is fitted into the fitting hole 22 in the female connector 20 while the pair of ribs 32, formed on the upper surface (FIG. 1) of the housing 31, are guided respectively by the ribs 26 of the female connector 20. The female terminals are mounted within the housing 31 of the male connector 30 which is to be fitted into the fitting hole 22 in the female connector 20.

At the time of connection of the connector, each of the ribs 32 is inserted between each rib 26 (provided within the fitting hole 22 of the female connector 20) and the corresponding housing side wall 21*a*.

The elastic lock portion 33 is formed integrally (or separately) on the upper surface (FIG. 1) of the housing 31 of the male connector 30, and is disposed between the pair of ribs 32. At the time of connection of the connector, the lock portion 33 is inserted between the pair of ribs 26 provided within the fitting hole 22.

A lock projection 34 is formed on a predetermined portion of an upper surface (FIG. 1) of the lock portion 33, and this lock projection 34 can be fitted in the lock portion-retaining portion 23 of the female connector 20.

Until the housing 31 of the male connector 30 is inserted into a predetermined position in the fitting hole 22 in the female connector 20, the lock projection 34 of the lock portion 33 is held in sliding contact with the upper surface (FIG. 1) of the fitting hole 22 in the female connector 20, so that the lock portion 33 is pressed and displaced downward (FIG. 2). At this time, because of a reaction force produced as a result of this displacement, the lock portion 33 urges the housing 31 of the male connector 30 downward (FIG. 2), so that the bottom surface (FIG. 2) of the housing 31 of the male connector 30 is held in sliding contact with the guide portions 25 on the female connector 20.

When the housing 31 of the male connector 30 reaches the innermost position (FIG. 1) within the fitting hole 22 in the female connector 20, the pressing of the lock projection 34 by the housing 21 of the female connector 20 is canceled, so that the lock portion 33 is restored from the downwardly-displaced condition into its original condition (shown in FIG. 2). In this condition, a right end surface (FIG. 2) of the lock projection 34 is engaged with a right end surface (FIG. 2) of the lock portion-retaining portion 23 of the female connector 20. Therefore, the lock portion 33 prevents the male connector 30 from being disengaged (or withdrawn in a right-hand direction in FIG. 2) from the female connector 20.

The operation of this embodiment will now be described.

At the time of connection of the connector, that is, when the housing 31 of the male connector 30 begins to be fitted into the fitting hole 22 in the housing 21 of the female connector 20, the lock portion 33 of the male connector 30, while displaced downward (FIG. 2), is inserted between the pair of ribs 26 on the female connector 20. At this time, the housing 31 of the male connector 30, while pressed or held in sliding contact with the guide portions 25 on the housing 21 of the female connector 20 by the reaction force produced as a result of the displacement of the lock portion 33, advances toward the inner end (FIG. 1) of the fitting hole 22.

Before the front end of the housing 31 of the male connector 30 in the connector fitting direction A reaches the reference position B of the elastic portion 24 within the fitting hole 22 in the housing 21 of the female connector 22, that portion of the elastic portion 24, disposed at a level lower than the guide portions 25, will not contact the housing 31 of the male connector 30.

Therefore, the insertion force, required for the connector 10, will not be increased by the resilient force of the elastic portion 24, and the required insertion force for the connector 10 can be kept to a low level. And besides, the guide portions 25 on the housing 21 of the female connector 20 prevent the elastic portion 24 from striking engagement with the housing 31 of the male connector 30, and therefore the elastic portion 24 is positively protected from damage resulting from such interference.

When the front end of the housing 31 of the male connector 30 in the connector fitting direction A reaches the reference position B of the elastic portion 24 within the fitting hole 22 in the housing 21 of the female connector 20, the housing 31 of the male connector 30 contacts the elastic portion 24, and then the housing 31 further moves toward the inner end (FIG. 1) of the fitting hole 22 to gradually press the elastic portion 24 downward (FIG. 1). As a result, the distal end portion 24*b* of the elastic portion 24 is gradually turned or displaced downward (FIG. 2) about the proximal end 24*a*.

When the housing 31 of the male connector 30 reaches the innermost position within the fitting hole 22 in the housing 21 of the female connector 20, the distal end portion 24*b* of the elastic portion 24 is displaced downward (FIG. 2) in the predetermined amount about the proximal end 24*a*. In this condition, because of the reaction force produced as a result of this displacement, the elastic portion 24 urges the housing 31 of the male connector 30 in the direction (upward in FIG. 2) of fitting of the lock portion 33 into the lock portion-retaining portion 23.

The housing 31 of the male connector 30 is thus urged upward (FIG. 2) by the elastic portion 24, so that each rib 26 on the female connector 20 is firmly held at its distal end (lower end in FIG. 1) against an engagement surface of the housing 31 lying between the corresponding rib 32 and the lock portion 33. Therefore, the movement and vibration of the housings 21 and 31 of the two connectors 20 and 30 relative to each other are sufficiently suppressed. And besides, the lock portion 33 is not excessively urged or pressed upward, and therefore the lock arm (lock portion) will not lose its elastic property.

As described above, in the above embodiment, when the housing 31 of the male connector 30 reaches the reference position B during the connector-fitting operation, the elastic portion 24, provided at the bottom surface (FIG. 1) of the fitting hole 22 in the housing 21 of the female connector 20, contacts the bottom surface (FIG. 2) of the housing 31 of the male connector 30, and is pressed and displaced downward (FIG. 2) by this bottom surface. Therefore, because of the reaction force produced as a result of this displacement, the elastic portion 24 keeps on urging the housing 31 of the male connector 30 in the direction (upward in FIG. 2) of fitting of the lock portion 33 into the lock portion-retaining portion 23.

Therefore, before the front end of the housing 31 of the male connector 30 in the connector fitting direction A reaches the reference position B of the elastic portion 24, the insertion force, required for the connector-fitting operation, can be kept to a low level, and therefore the connector-fitting operation can be carried out easily. In the connector fitted condition, the housing 31 of the male connector 30 is always urged upward (FIG. 2) within the fitting hole 22 in the female connector 20 by the elastic portion 24, and therefore the relative movement and vibration of the housings 21 and 31 of the two connectors 20 and 30 relative to each other can be sufficiently suppressed, and besides the disengagement of the lock portion 33 from the lock portion-retaining portion 23 can be prevented.

Therefore, the incomplete contact, uneven wear and so on of the connector terminals can be positively prevented, and also the withdrawal of the male connector of the connector 10 can be prevented, thereby enhancing the performance and durability of the connector.

The elastic portion 24 is arranged to extend from its proximal end 24*a* to its distal end portion 24*b* along the connector fitting direction A, and the guide portions 25 are provided respectively on the opposite sides of the elastic portion 24, and extend along the connector fitting direction A. Therefore, the impingement, gouging and so on against the elastic portion 24 during the connector-fitting operation can be positively prevented, and the deterioration of the elastic portion 24, such as wear and damage due to such impingement and gouging, can be sufficiently suppressed. Therefore, the predetermined performance can be maintained for a long period of time.

The elastic portion 24 can be easily formed integrally with the housing 21 of the female connector 20, by using an existing molding technique in which a slide metal core is moved in one direction during the molding of the housing 21. Therefore, since the elastic portion 24 can be formed, using the existing molding technique, the manufacturing cost is not increased.

In view of the highest concept of the present invention, the construction of the connector should not be merely limited to the above described embodiment.

In the present invention, the urging mechanism may be disposed on at least one of the housings of the female and male connectors. The urging mechanism keeps on urging in the predetermined direction when the male connector is fitted in the female connector. With this construction, a relative movement between the housings of the two connectors which have been fitted to each other, is sufficiently suppressed. Therefore, the incomplete contact, uneven wear and so on of the terminals can be positively prevented.

In addition, in the present invention, when the male connector is fitted in the female connector, the urging mechanism keeps on urging at least one of the housings of the female and male connectors in a direction in which retainment of the lock portion by the lock portion-retaining portion is reinforced. Namely, the direction is a direction for preventing the cancellation of the retainment of the lock portion by the lock portion-retaining portion. Therefore, a relative movement between the housings of the two connectors, connected together, is sufficiently suppressed, and besides the cancellation of the retainment of the lock portion by the lock portion-retaining portion is prevented. Accordingly, the incomplete contact, uneven wear and so on of the terminals can be positively prevented, and besides the withdrawal of the male connector can be prevented.

Moreover, in the present invention, the urging mechanism may be disposed on at least one of the housings of the female and male connectors, and when the male connector is fitted in the female connector, the urging mechanism keeps on urging in the predetermined direction. The urging force, applied from the urging mechanism, does not act before the male connector is fitted into the predetermined position in the female connector. Therefore, before the male connector is fitted into the predetermined position in the female connector, the insertion force, required for fitting the two connectors, is kept to a low level, and in the connector fitted condition, a relative movement between the two housings is sufficiently suppressed. Therefore, the insertion force, required for fitting the two connectors, is not increased, and the incomplete contact, uneven wear and so on of the terminals can be positively prevented.

What is claimed is:

1. A connector, comprising:

a female connector housing into which a male terminal is insertable;

a male connector housing, into which a female terminal is insertable, and which is fittable in the female connector housing so that the female terminal of the male connector housing is electrically connected to the male terminal of the female connector housing;

a lock portion-retaining portion provided on a first wall portion of one of said female and male connector housings; and an urging mechanism disposed on a second wall portion of one of the female and male connector housings, the urging mechanism keeping on urging at least another of the female and male connector housings against each other when the male connector housing is fitted in the female connector housing, wherein an urging force, applied from the urging mechanism, acts on at least one of the female and male connector housings when the male connector is located into a fully fitting condition in the female connector, and where a portion of said urging force begins to act on at least one of the female and male connector housings when the male connector is located into a predetermined fitted condition in the female connector which occurs prior to said fully fitted condition.

2. The connector of claim 1, wherein said lock portion-retaining portion is provided at the other one of the female and male connector housings of said urging mechanism, and wherein when the male connector is fitted in the female connector, the lock portion-retaining portion retains the lock portion so as to hold the female and male connector housings in a mutually-fitted condition; and wherein when the male connector housing is fitted in the female connector housing, the urging mechanism keeps on urging at least one of the female and male connector housings in a direction in which retainment of the lock portion by the lock portion-retaining portion is reinforced.

3. The connector of claim 2, wherein an urging force, applied from the urging mechanism, begins to act on at least one of the female and male connector housings when the male connector is located into a predetermined position in the female connector.

4. The connector of claim 1, wherein the urging mechanism comprises an elastic portion formed integrally on the at least one of the female and male connector housings, wherein the connector further comprises a guide portion having a recessed portion, the guide portion being formed on the at least one of the female and male connector housings, and wherein the elastic portion is located in the recessed portion of the guide portion.

5. The connector of claim 1, wherein the urging mechanism comprises an elastic portion formed integrally on the at least one of the female and male connector housings, wherein the connector further comprises a guide portion having a recessed portion, the guide portion being formed on the at least one of the female and male connector housing, and wherein the elastic portion is located in the recessed portion of the guide portion.

6. The connector of claim 1, wherein said urging mechanism is positioned opposite said lock portion on one of said male and female connector housings.

7. The connector of claim 1, wherein said second wall portion is located on the other of said male and female connector housings than said first wall portion.

8. The connector of claim 2, wherein the urging mechanism comprises an elastic portion formed integrally on the at least one of the female and male connector housings, wherein the connector further comprises a guide portion having a recessed portion, the guide portion being formed on the at least one of the female and male connector housings, and wherein the elastic portion is located in the recessed portion of the guide portion.

9. The connector of claim 3, wherein the urging mechanism comprises an elastic portion formed integrally on the at least one of the female and male connector housings, wherein the connector further comprises a guide portion having a recessed portion, the guide portion being formed on the at least one of the female and male connector housings, and wherein the elastic portion is located in the recessed portion of the guide portion.

10. The connector of claim 4, wherein the elastic portion is formed in a cantilever-like manner, and a distal end portion of the elastic portion is slightly projected from an upper surface of the guide portion.

11. The connector of claim 5, wherein the elastic portion is formed in a cantilever-like manner, and a distal end portion of the elastic portion is slightly projected from an upper surface of the guide portion.

12. The connector of claim 8, wherein the elastic portion is formed in a cantilever-like manner, and a distal end portion of the elastic portion is slightly projected from an upper surface of the guide portion.

13. The connector of claim 9, wherein the elastic portion is formed in a cantilever-like manner, and a distal end portion of the elastic portion is slightly projected from an upper surface of the guide portion.

14. A connector, comprising:

a female connector housing;

a male connector housing which is fittable in said female connector housing;

a lock portion provided on a first wall portion of one of said female and male connector housings; and an urging mechanism disposed on a second wall portion of at least one of the female and male connector housings, the urging mechanism keeping on urging at least another of the female and male connector housings against each other when the male connector housing is fitted in the female connector housing, wherein an urging force, applied from the urging mechanism, acts on at least one of the female and male connector housings when the male connector is located into a fully fitting condition in the female connector, and where a portion of said urging force begins to act on at least one of the female and male connector housings when the male connector is located into a predetermined fitted condition in the female connector which occurs prior to said fully fitted condition.

15. The connector of claim 14, wherein said lock portion is provided at the other one of the female and male connector housings of said urging mechanism, and wherein when the male connector is fitted in the female connector, the lock portion holds the female and male connector housings in a mutually-fitted condition.

16. The connector of claim 14, wherein when the male connector housing is fitted in the female connector housing, the urging mechanism keeps on urging at least one of the female and male connector housings in a direction in which retainment of the lock portion by the lock portion-retaining portion is reinforced.

17. The connector of claim 14, wherein an urging force, applied from the urging mechanism, begins to act on at least one of the female and male connector housings when the male connector is located into a predetermined position in the female connector.

18. The connector of claim 14, wherein the urging mechanism comprises an elastic portion formed integrally on the at least one of the female and male connector housings, wherein the connector further comprises a guide portion having a recessed portion, the guide portion being formed on the at least one of the female and male connector housings, and wherein the elastic portion is located in the recessed portion of the guide portion.

19. The connector of claim 14, wherein said urging mechanism is positioned opposite said lock portion on one of said male and female connector housings.

20. The connector of claim 14, wherein said second wall portion is located on the other of said male and female connector housings than said first wall portion.

21. The connector of claim 15, wherein the urging mechanism comprises an elastic portion formed integrally on the at least one of the female and male connector housings, wherein the connector further comprises a guide portion having a recessed portion, the guide portion being formed on the at least one of the female and male connector housings, and wherein the elastic portion is located in the recessed portion of the guide portion.

22. The connector of claim 18, wherein the elastic portion is formed in a cantilever-like manner, and a distal end portion of the elastic portion is slightly projected from an upper surface of the guide portion.

23. The connector of claim 21, wherein the elastic portion is formed in a cantilever-like manner, and a distal end portion of the elastic portion is slightly projected from an upper surface of the guide portion.

* * * * *